US007770553B2

(12) United States Patent
Gorenflo et al.

(10) Patent No.: US 7,770,553 B2
(45) Date of Patent: Aug. 10, 2010

(54) MANUAL WORKING MACHINE

(75) Inventors: Ernst Gorenflo, Heinsheim (DE); Carsten Ziegs, Hamburg (DE)

(73) Assignee: DOLMAR GmbH, Hamburg (DE)

( * ) Notice: Subject to any disclaimer, the term of this patent is extended or adjusted under 35 U.S.C. 154(b) by 1143 days.

(21) Appl. No.: 10/577,283

(22) PCT Filed: Oct. 19, 2004

(86) PCT No.: PCT/EP2004/011816

§ 371 (c)(1),
(2), (4) Date: Apr. 24, 2006

(87) PCT Pub. No.: WO2005/039807

PCT Pub. Date: May 6, 2005

(65) Prior Publication Data

US 2008/0314338 A1 Dec. 25, 2008

(30) Foreign Application Priority Data

Oct. 24, 2003 (DE) ..... 203 16 483

(51) Int. Cl.
*F02N 11/12* (2006.01)

(52) U.S. Cl. ..... 123/179.26; 123/41.33; 123/41.64; 30/381; 30/382

(58) Field of Classification Search ..... 210/1 A, 210/1 R; 322/10; 320/104; 290/1 R, 1 A, 290/46; 123/41.33, 41.64, 41.65, 41.66, 123/41.67, 179.26; 30/387, 380, 382, 379, 30/385; 237/12.4; 454/184; 60/319; 83/831, 83/834, 820, 812; *F02N 11/12*
See application file for complete search history.

(56) References Cited

U.S. PATENT DOCUMENTS

| | | | | |
|---|---|---|---|---|
| 4,534,005 | A | 8/1985 | Nagashima et al. | |
| 4,720,638 | A | 1/1988 | Vollbrecht et al. | |
| 5,028,858 | A | 7/1991 | Schnizler et al. | |
| 7,148,580 | B2 * | 12/2006 | Sodemann et al. | 290/1 A |
| 7,420,352 | B2 * | 9/2008 | Kranz | 320/104 |

FOREIGN PATENT DOCUMENTS

| | | | |
|---|---|---|---|
| DE | 93 09 436 | U1 | 11/1994 |
| DE | 101 03 995 | A1 | 8/2002 |

* cited by examiner

*Primary Examiner*—Stephen K Cronin
*Assistant Examiner*—Keith Coleman
(74) *Attorney, Agent, or Firm*—Kelly, Lowry & Kelley, LLP

(57) ABSTRACT

In order to provide a handheld work machine that does not require expensive start circuitry for the critical start-up phase of the combustion engine, and in which nevertheless the required constant supply voltage for the engine is present in order to achieve optimum starting behavior, a handheld work machine is provided with at least one combustion engine which in operation requires a supply voltage, and with a voltage generator that supplies a generator voltage that depends on the rotary speed of the combustion engine, which generator voltage is used to generate the supply voltage, wherein the handheld work machine is electrically connected to an additional voltage source that prior to starting the combustion engine provides the required supply voltage that at this point in time is not yet present.

19 Claims, 3 Drawing Sheets

MANUAL WORKING MACHINE

TECHNICAL FIELD

The invention relates to a handheld work machine, in particular a chainsaw, hedge clippers, leaf blower, lawn edger, abrasive cutting-off machine or the like, comprising at least one combustion engine which during operation requires a supply voltage, and a voltage generator which generates a voltage that is independent of the rotary speed of the combustion engine, which generator voltage is used to generate the supply voltage. In this arrangement, as a rule, the supply voltage is used to provide an ignition voltage on the one hand, and a control voltage on the other hand. The ignition voltage furnishes the necessary electrical energy to ignite the ignition procedure in the engine. On the other hand the control voltage makes possible electrical/electronic control or regulation of the combustion engine. Furthermore, if the unit incorporates an engine management system, the control voltage can also be used to activate any valve or electrical consumer (heated handle etc.) or the like.

STATE OF THE ART

Such handheld work machines are associated with a known problem in that the required supply voltage, particularly in the start-up phase, cannot adequately be generated by the voltage generator in order to provide both the required ignition voltage and the necessary control voltage. Consequently, as a rule, in this situation the energy generated by the voltage generator is used to provide the required ignition energy. However, since in such a case during the start-up phase the required control voltage for electrical/electronic control or regulation of the combustion engine is not present, the combustion engine's starting behaviour is impeded. It is precisely the starting behaviour of any handheld work machine that is a decisive factor in the convenience of such machines.

Thus from printed publication DE 295 06 350 U1 a particularly elaborate circuit arrangement is known which makes it possible to supply the electronics of the handheld work machines in the critical start phase with the necessary control voltage (rated direct voltage). In this arrangement the circuit according to the invention diverts part of the ignition energy for control functions, as a result of which the existing ignition energy does not remain constant. This in turn has a negative influence on the starting behaviour of the combustion engine, which cannot, however, be prevented without further ado. If in this situation the existing ignition energy is insufficient for igniting the compressed fuel mixture in the combustion chamber of the engine, because part of the voltage produced by the generator is used for control, then this leads to incorrect ignition, which cannot be compensated for by the incorporated control system. Consequently, efforts are made to also keep the ignition energy constant. However, this objective is not achieved by the circuit according to the invention. Furthermore, the control voltage diverted in this solution is not sufficient to implement electrical injection for the combustion engine.

PRESENTATION OF THE INVENTION, OBJECT, SOLUTION, ADVANTAGES

It is thus the object of the invention to provide a handheld work machine of the type mentioned in the introduction, which work machine does not require expensive start circuitry for the critical start-up phase of the combustion engine, and in which work machine nevertheless the constant supply voltage for the engine is present, which supply voltage is required to achieve optimal starting behaviour.

This object is met by the features stated in the characterising part of claim 1.

Preferred improvements of the handheld work machine are described in claims 2 to 12.

In a preferred embodiment variant of the handheld work machines the supply voltage required during operation of the combustion engine is split into an ignition voltage and a control voltage. Prior to or during starting of the engine the required control voltage is only supplied by the additional voltage source. In this way it is possible to dimension the additional voltage source to be as small as possible as far as its electrical output and its external dimensions are concerned. In this variant the ignition voltage required is exclusively generated by the voltage generator, which for this purpose, as already mentioned above, provides adequate generator voltage in the low speed range.

Expediently, in a further embodiment of the handheld work machine the additional voltage source comprises at least one rechargeable battery or accumulator. In this way the voltage source or the rechargeable battery can be recharged, i.e. can store energy, time and again, if the energy has been completely used up during starting of the combustion engine. In this way the additional voltage source does not have to be renewed when its stored energy has been consumed but can simply be recharged in order to make possible it reuse. In order to cause the rechargeable battery to become charged it can be recharged either by an external charging set or by the voltage generator of the work machine by means of a charging circuit arranged downstream. In this variant the external charging set can be electrically connected to the rechargeable battery by way of a connector, or the rechargeable battery is removed from the work machine and is then directly connected to the external charging set. In the other variant, in which the rechargeable battery is charged by way of the voltage generator of the work machine, before the starting procedure the rechargeable battery first provides the required supply voltage, and then, after successful engine start, is charged by the available adequate generator voltage. For this purpose a charging circuit is provided in the work machine, which charging circuit makes possible and regulates the charging procedure. It is understood that the rechargeable battery can only be recharged if the generated generator voltage is sufficient, i.e. if it is adequate to not only provide the necessary supply voltage but also the charge voltage for the rechargeable battery. However, this requires that the engine has reached the required rotary speed.

According to another improvement of the handheld work machine the additional voltage source comprises at least one standard battery. In contrast to the rechargeable battery, this standard battery is not rechargeable and is thus exchanged if its voltage is no longer adequate to support the starting procedure of the combustion engine. In this improvement it is advantageous if the standard battery only needs to supply the required control voltage during the starting procedure (according to claim 2), because in this way it can nevertheless be used for numerous starting procedures. Thus, to save both weight and cost, commercially available standard batteries such as for example micro, mignon, block, 9-volt block batteries etc. can be used.

In an improvement of the work machine the standard battery is not integrated in the machine as it would be more difficult to be exchanged in this way. Advantageously, with the use of a rechargeable battery as an additional voltage source this rechargeable battery can easily also be integrated in the machine, because as a rule the rechargeable battery does not require replacing as it is rechargeable. In this way the additional voltage source is well protected against dust, water and other external influences and is safely arranged in the machine.

In another improvement of the work machine the additional voltage source can be plugged to or in or into the housing of the handheld work machine. This improvement can be advantageous in particular in the case of an existing standard battery as an additional voltage source. This makes possible simple replacement of the additional voltage source if this voltage source is spent. Of course, by this measure too, a rechargeable battery can simply be replaced. To this effect the work machine can comprise an open or closed battery compartment. In a closed battery compartment the cover protects the standard battery or the rechargeable battery against external environmental influences.

In another embodiment of the work machine the additional voltage source is arranged externally in relation to the housing of the handheld work machine and is electrically connected to the work machine by way of an electrical conductor and a plug-type connection. Thus this additional voltage source can for example be carried on the belt of the operator/worker. Likewise it is imaginable that after the starting procedure of the combustion engine the additional voltage source is separated from the work machine by way of the plug-type connection and that the machine can be used on its own. Consequently the additional voltage source can be stored in a safe place that is free of vibrations, independently of the work machine, or joint use of the energy supply of other devices (for example available to the operator), for example a torch, a PDA, a mobile telephone or the like can be provided.

A further variant of the handheld work machine provides for the additional voltage source to be electrically connected to further electrical or electronic circuits or further auxiliary devices of the handheld work machine, and for the additional voltage source to supply voltage to these. In such an arrangement it is for example imaginable that a headlight is affixed to the work machine so as to illuminate the workplace. Likewise, as already described, by means of the voltage source an electrical injection system can be operated before or during the starting procedure of the engine. Of course other application options too are imaginable, such as for example an electronic locking device which first has to be unlocked before operation of the work machine becomes possible.

An expedient improvement of the handheld work machine provides for a monitoring device to be provided, which monitors the charge state of the additional voltage source and indicates said charge state by a visual and/or acoustic signal. In this way it is possible, by way of the monitoring device, to either replace the additional voltage source in good time, or to recharge it if the existing energy of the voltage source has very largely been consumed. However, this monitoring device can also be used to monitor and correspondingly display the charge procedure of a rechargeable battery. For example, LEDs or lights or different colours can be used which indicate a critical state of the additional voltage source in red, while indicating the normal state in green. Likewise the monitoring device can display the extent of the voltage of the additional voltage source in a digital or analogue way.

Furthermore, an improvement of the handheld work machine is proposed in which the additional voltage source can be switched on and off by way of a start/stop switch. By means of this start/stop switch it is possible to prevent a situation where the electronics of the work machine place a load on the additional voltage source as a permanent consumer, in which case said additional voltage source after a very short time would already be unable to function although the machine is not in operation. Likewise the above-described monitoring device can be switched on and off by means of the switch. To prevent unintended starting of the combustion engine this switch can also be used to interrupt the electrical ignition device.

An advantageous improvement of the invention provides for a monitoring device to be provided for acquiring the charge option or recharge option of the additional voltage source. This is a device for detecting whether standard batteries or rechargeable batteries are being used, and thus is a monitoring device that ascertains whether the energy storage devices used are rechargeable. Advantageously, if a rechargeable battery is detected, charging by an external charging set and/or by the voltage generator with a charging circuit is enabled, while when a standard battery is detected, charging or recharging is excluded so as to prevent the known problems associated with charging or recharging standard batteries. Such circuits are known per se from devices in the entertainment industry; by means of ascertaining form elements or characteristic elements of the voltage source they detect whether or not it is possible to engage in charging or recharging.

In another embodiment of the invention the handheld work machine can comprise an electric starter motor which is used to automatically start the combustion engine and for this purpose is electrically connected to the additional voltage source. This starter motor can be arranged in or on the work machine; however, this clearly increases the weight of the machine. This in turn can make handling of the machine more difficult. In order to avoid this disadvantage, the starter motor can also be merely mechanically coupled to the work machine for the duration of the starting procedure. As soon as the work machine has reached its regular idle speed, the starter motor can be decoupled from the machine.

BRIEF DESCRIPTION OF THE DRAWINGS

Below, the invention is explained in more detail using various exemplary embodiments with reference to the enclosed drawings. The following are shown.

THE BEST WAY OF IMPLEMENTING THE INVENTION

Figure 1:
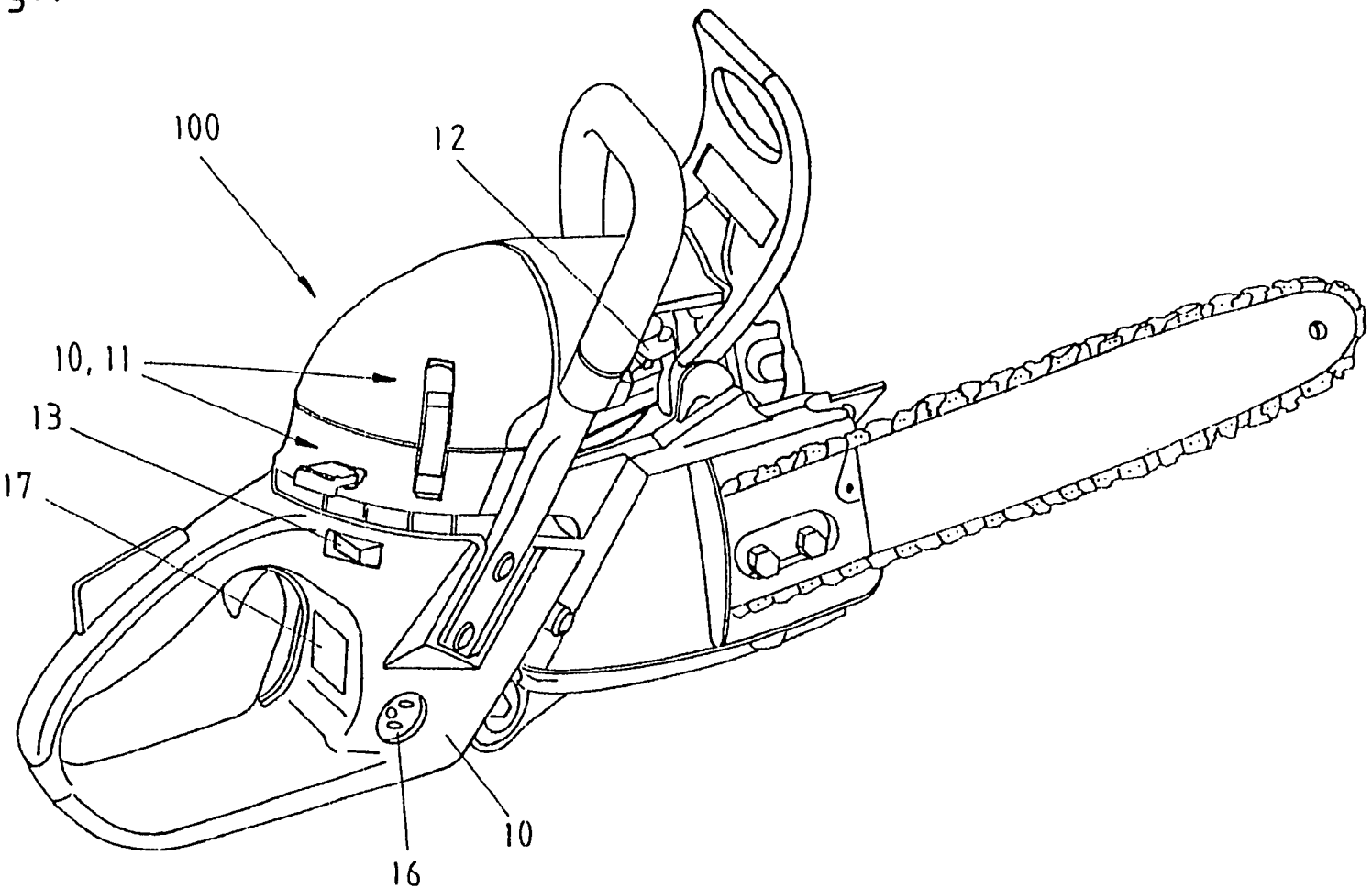
FIG. 1 a three-dimensional view of a handheld work machine according to the invention, in the form of a chainsaw, comprising a plug-type connection for the additional externally arranged voltage source.
Figure 2:
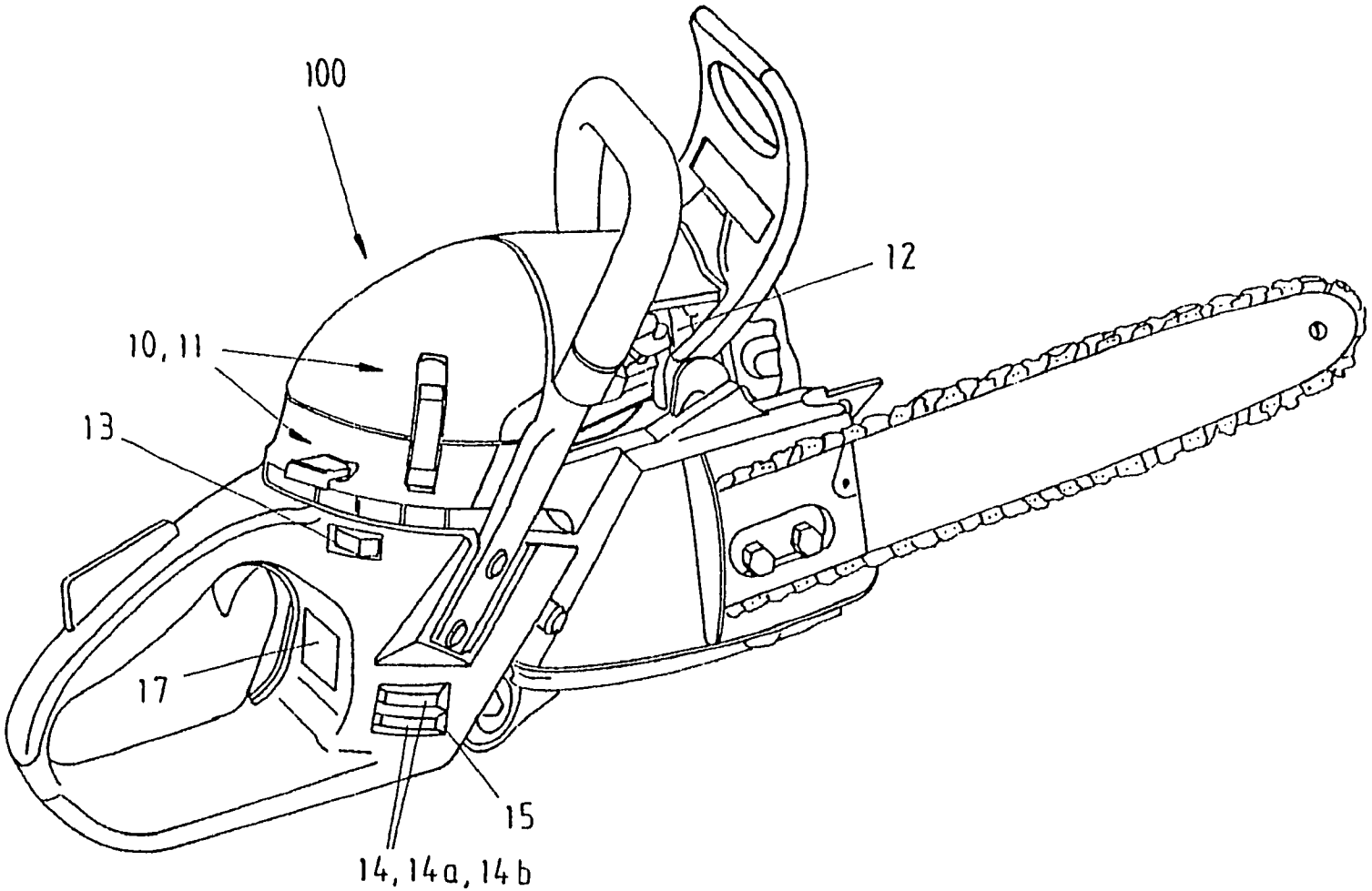
FIG. 2 a three-dimensional view of a handheld work machine that is comparable to that shown in FIG. 2, except that it comprises an additional voltage source in a special accommodation compartment in the machine.
Figure 3:
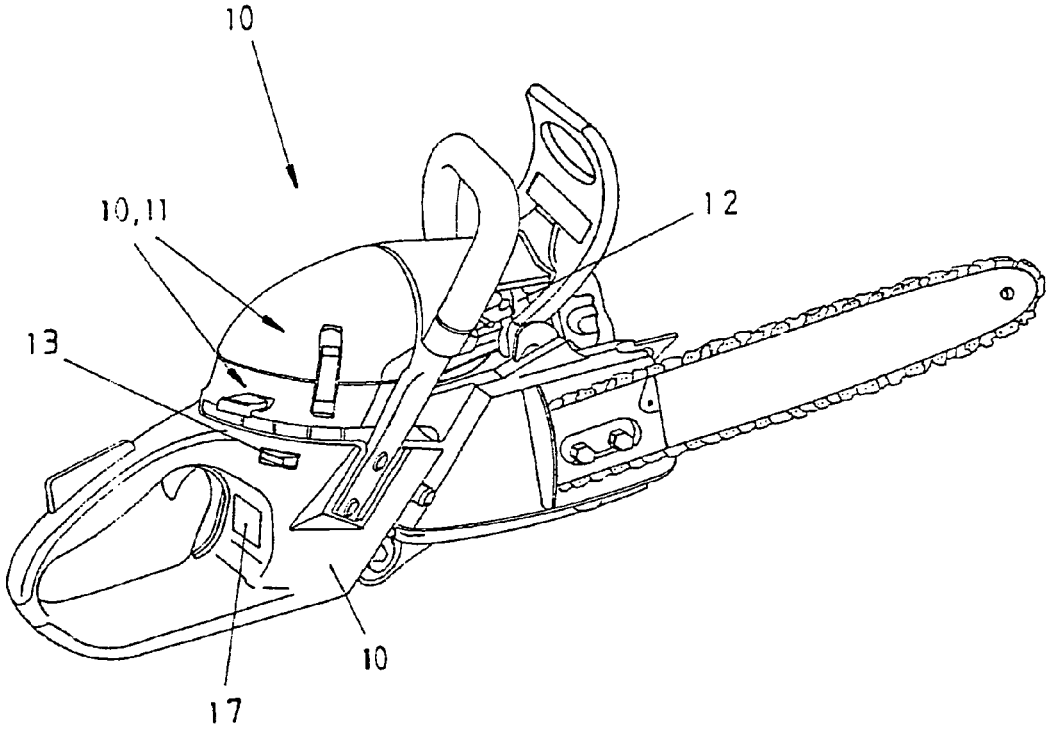
FIG. 3 a three-dimensional view of a handheld work machine that is comparable to the work machine shown in FIGS. 2 and 3, except that it comprises an additional integrated voltage source within the machine.

FIGS. 1 to 3 show a handheld work machine 100 in the form of a chainsaw.

In the embodiment of the work machine 100 of FIG. 1 an additional voltage source 14 is used, which is arranged so as to be external in relation to the housing 10 of the machine 100. In this figure the additional voltage source 14 is not shown. However, this voltage source 14 is connected by way of the plug-type connection 16 shown, by means of an electrical connector, to the machine 100. In this arrangement the plug-type connection 16 comprises a connector which, with a suitable counter connector on the side of the additional voltage source 14, establishes an electrical contact by way of one or several conductors. The additional voltage source 14 can be a commercially available standard battery 14*b* or a rechargeable battery 14*a*. It is also imaginable that the additional voltage source 14 is a mains-operated voltage device which after the start of the combustion engine 12 is separated from the work machine 100. The built-in monitoring device 17 makes it possible to monitor whether or not the additional voltage source 14 still supplies enough energy. The monitoring device 17 can indicate this to the operator either by a visual signal and/or by an acoustic signal.

The embodiment shown in FIG. 2 shows that the additional voltage source 14 comprises two commercially-available rechargeable batteries 14*a* or standard batteries 14*b*. They are arranged in the accommodation compartment 15 that is provided for this purpose. The battery compartment 15 can be closed with a cover (not shown) so that the additional voltage source 14 (in the embodiment shown rechargeable batteries 14*a* or standard batteries 14*b*) that is located underneath it is protected against dirt, water etc. This interior battery compartment 15 makes it very easy to exchange or replace the rechargeable batteries 14*a* or the standard batteries 14*b* if they are spent or if they have to be recharged by an external charging set. To prevent any unnecessary load on the voltage sources 14 by the downstream electronics of the work machine 100, the switch 13 can interrupt the electrical contact. In this case the monitoring device 17 is also switched off so that in this way no closed-circuit current flows from the additional voltage source 14. As soon as the switch 13 is switched on, the monitoring device 17 can display the actual current of the current source 14, and electrical contact to the electrics or electronics of the work machine 100 is present. Likewise, the switch 13 also unlocks the ignition device so that the combustion engine 12 can be started. However, the switch 13 can also feature an additional touch control position, in which only the monitoring device 17 is switched on in order to query the state of the additional voltage source 14.

FIG. 3 shows the handheld work machine 100 with an integrated additional voltage source 14. The latter is for example arranged beneath the cover 11 of the housing 10. To nevertheless make it possible to exchange or replace the additional voltage source 14 the cover 11 is secured with catch-type closures to the work machine 100. As already mentioned, in this exemplary embodiment it is advantageous if the additional voltage source 14 comprises a rechargeable battery 14*a*.

In conclusion it should be mentioned that the invention is not just limited to the combinations of the technical means as described, but instead that other combinations that are not described are also possible.

The invention claimed is:

1. A handheld work machine (100) comprising at least one combustion engine (12) which in operation requires a supply voltage split into an ignition voltage and a control voltage, and comprising a voltage generator which supplies a generator voltage that depends on the rotary speed of the combustion engine (12), which generator voltage is used to generate the supply voltage, characterised in that the handheld work machine (100) is electrically connected to an additional integrated voltage source (14) that can be plugged in or into a housing (10) of the handheld work machine (100), which additional voltage source only provides the required control voltage prior to starting the combustion engine (12).

2. The handheld work machine according to claim 1, characterised in that the voltage supplied by the additional voltage source (14) is independent of the rotary speed of the combustion engine (12).

3. The handheld work machine according to claim 1, characterised in that the additional voltage source (14) comprises at least one rechargeable battery (14*a*).

4. The handheld work machine according to claim 3, characterised in that the rechargeable battery (14*a*) is rechargeable either by an external charging set or by the voltage generator with a charging circuit arranged downstream.

5. The handheld work machine according to claim 1, characterised in that the additional voltage source (14) comprises at least one replaceable standard battery (14*b*).

6. The handheld work machine according to claim 1, characterised in that the additional voltage source (14) is integrated in the handheld work machine (100).

7. The handheld work machine according to claim 1, characterised in that the additional voltage source (14) is arranged externally in relation to the housing (10) of the handheld work machine (100) and is electrically connected to the work machine (100) by way of an electrical conductor and a plug-type connection (16).

8. The handheld work machine according to claim 7, characterised in that the additional voltage source (14) is electrically connected to further electrical or electronic circuits or further auxiliary devices of the handheld work machine (100), and supplies a voltage to these.

9. The handheld work machine according to claim 1, characterised in that a monitoring device (17) is provided which monitors the charge state of the additional voltage source (14) and indicates said charge state by a visual and/or acoustic signal.

10. The handheld work machine according to claim 1, characterised in that a monitoring device is provided for acquiring the charge option or recharge option of the additional voltage source (14).

11. The handheld work machine according to claim 1, characterised in that the additional voltage source (14) can be switched on and off by way of a start/stop switch (13).

12. The handheld work machine according to claim 1, characterised in that the additional voltage source (14) is electrically connected to an electric starter motor that is provided for automatically starting the combustion engine (12) of the handheld work machine (100).

13. A method for starting and operating a handheld work machine comprising at least one combustion engine that in operation requires a supply voltage which is split into an ignition voltage and a control voltage, and comprising a voltage generator that provides the supply voltage, which depends upon the rotary speed of the combustion engine, said method comprising the steps of:

electrically connecting an additional voltage source to the handheld work machine;

supplying the control voltage for the at least one combustion engine from the additional voltage source prior to and while starting the at least one combustion engine; and supplying the control voltage for the at least one combustion engine from the voltage generator after starting the at least one combustion engine.

14. The method for starting and operating a handheld work machine of claim 13, further comprising the step of supplying the ignition voltage for the at least one combustion engine from the voltage generator while starting the at least one combustion engine.

15. The method for starting and operating a handheld work machine of claim 13, wherein the additional voltage source is constant and the amount of voltage supplied does not depend on the rotary speed of the combustion engine.

16. The method for starting and operating a handheld work machine of claim 13, further comprising the step of disconnecting the additional power source from the handheld work machine after starting the at least one combustion engine.

17. The method for starting and operating a handheld work machine of claim 13, wherein the additional voltage source is integrated with a housing of the handheld work machine and is electrically connected to the handheld work machine by being plugged in or into the housing.

18. The method for starting and operating a handheld work machine of claim 13, wherein the additional voltage source is disposed externally to a housing of the handheld work machine and is electrically connected to the handheld work machine by an electrical conductor and a plug-type connection.

19. The method for starting and operating a handheld work machine of claim 18, wherein the additional voltage source is electrically connected to additional electrical or electronic circuits or auxiliary devices of the handheld work machine and supplies voltage thereto.

* * * * *